United States Patent [19]

Roepke et al.

[11] 4,012,077

[45] Mar. 15, 1977

[54] LINEAR CUTTING ROTARY HEAD CONTINUOUS MINING MACHINE

[75] Inventors: Wallace W. Roepke, Excelsior; David P. Lindroth, Apple Valley; Joseph W. Rasmussen, Minneapolis, all of Minn.

[73] Assignee: The United States of America as represented by the Secretary of the Interior, Washington, D.C.

[22] Filed: July 2, 1976

[21] Appl. No.: 702,373

[52] U.S. Cl. ..... 299/76; 299/64; 299/85; 299/89

[51] Int. Cl.[2] ..... E21C 27/24

[58] Field of Search ..... 299/64, 73, 75, 85, 299/76, 86, 89; 175/91, 319, 106

[56] References Cited

UNITED STATES PATENTS

| | | | |
|---|---|---|---|
| 2,694,563 | 11/1954 | Graham | 299/86 X |
| 2,758,826 | 8/1956 | Paget | 299/89 X |
| 2,825,544 | 3/1958 | Ahlson | 299/85 |
| 3,288,536 | 11/1966 | Galis et al. | 299/86 X |
| 3,290,096 | 12/1966 | Stalker | 299/86 X |

*Primary Examiner*—Ernest R. Purser
*Attorney, Agent, or Firm*—Thomas Zack; Donald R. Fraser

[57] ABSTRACT

The triangular-shaped rotary head mounted on an eccentrically driven shaft rotates at a low speed in a path determined by a ring/pinion gear ratio, such that cutting tools mounted on the apices of the triangular-shaped rotary head follow a square path entering the face of the coal seam to be cut at a top corner and making a long linear vertical cut at a constant depth of approximately one and one-half times the diameter of the rotary head greatly reducing dust generation and methane ignition potential, while increasing productivity.

10 Claims, 5 Drawing Figures

LINEAR CUTTING ROTARY HEAD CONTINUOUS MINING MACHINE

BACKGROUND OF THE INVENTION

1. FIELD OF THE INVENTION

This invention relates to continuous coal mining machines and more particularly to an improved rotary cutting head which permits an increase in production while decreasing respiral dust formed during the cutting process.

2. DESCRIPTION OF THE PRIOR ART

Many different methods have been employed in the mining of coal and in the past fifty years the development of mechanization in the mining of coal has virtually eliminated manual mining techniques. A large increase in productivity has been obtained by the design and development of the rotary head continuous mining machines which use a multiplicity of bits fixed to a rotating drum which may be advanced into the coal face and moved up or down to fragment the face of the coal seam or formation. With over 2,000 of these machines now in use and accounting for approximately one-half of the production of coal from underground coal mines, the employment of these machines has increased the problem of primary dust generation of the faces during cutting by rotation of the cutting teeth or tools. During the fragmentation process at the face of the coal deposit, which is responsible for the production of both airborne and non-airborne dust, dust generation is determined by such machine parameters as bit type, bit angle, spacing between bits, depth of cut and rotational speed. Research by the Bureau of Mines has involved an analysis of the effect of rotary cutting heads on a continuous mining machine and a determination of where and how primary dust is produced at the face. As result of that analysis, it has become apparent that where a pick or tool bit enters the coal face at zero depth due to its epitroichoidal path, the machine has an inherent potential for high dust production with an associated high energy demand. Thus, presently employed rotary head continuous mining machines are inherent dust producers. It has been determined that the limiting factor to dust reduction is the circular path with continuous entry and exit of each pick or bit in the face.

It is accordingly an object of the present invention to provide a new linear cutting rotary head for a continuous mining machine which will cut at a constant depth.

A further problem in the use of conventional rotary head continuous mining machines is that the constantly changing depth of a bit following an epitrichoidal path does not permit an optimum spacing for the cutting bits. Since deep cutting of coal with rotary machines appears to be the solution to dust generation during cutting, this presents the problem of using fewer bits with wide spacing to accommodate the deeper cutting most effectively which then produces coring at shallow cuts since there are too few bits for shallow cutting. Indeed, this is a paradox because one should cut deep to avoid dust but one increases the amount of dust by coring during deep cuts because there are too few bits. It is obvious, therefore, that the presently designed rotary head machines are therefore not amendable to dust reduction with high productivity due to their inherent design faults. It is apparent, therefore, that an ideal cutting machine would comprise a rotary head for high productivity using only deep linear cuts to reduce dust generation to a minimum while maintaining optimum bit spacing.

It is, therefore, a further object of this invention to provide an improved rotary head continuous mining machine which optimizes these three parameters.

It is a further object of this invention to provide an improved continuous mining machine which may be modified by the substitution of a new rotary cutting head which provides full linear shear and sump cuts without the necessity of modifying all other existing parts including those needed for propulsion, trackage electric and/or hydraulic motors to the power track, existing boom with vertical and/or horizontal movement and the existing means of collecting cut coal and conveying it to an appropriate shuttle car or belt transport system.

SUMMARY OF THE INVENTION

The present invention comprises a continuous mining machine having a chassis movable in the direction of its longitudinal axis, a boom carried by the chassis for pivotable movement through an arc at right angles to the direction of chassis movement, an eccentric crank mounted to said boom for rotation about an axis at right angles to the longitudinal axis of the boom. A head of triangular cross-sectional shape is rotatable eccentrically on said boom with cutting teeth mounted on the apices of said triangular-shaped head and projecting outwardly therefrom such that during rotation of the head, the cutting bits follow an essentially square path to cause said bits to enter the face of the coal formation at the front of said continuous cutting machine linearly to effect a sump motion and to make a long linear cut at constant depth a distance of approximately one and one-half times the diameter of rotary head producing said cutting motion.

Preferably, the bits are mounted to the apices generally longitudinally in line with the adjacent trailing face of the triangular head in terms of the direction of rotation of said head. The faces of the triangular-shaped cutting head may comprise spherical segments. A triangular-shaped rotary cutting head may be mounted on each side of the boom with the boom centered with respect to the chassis and the bits which are longitudinally spaced along the apices of each triangular shaped head are preferably longitudinally offset with respect to the bits of the other apices of the same head.

DESCRIPTION OF THE PREFERRED EMBODIMENT

Figure 1:
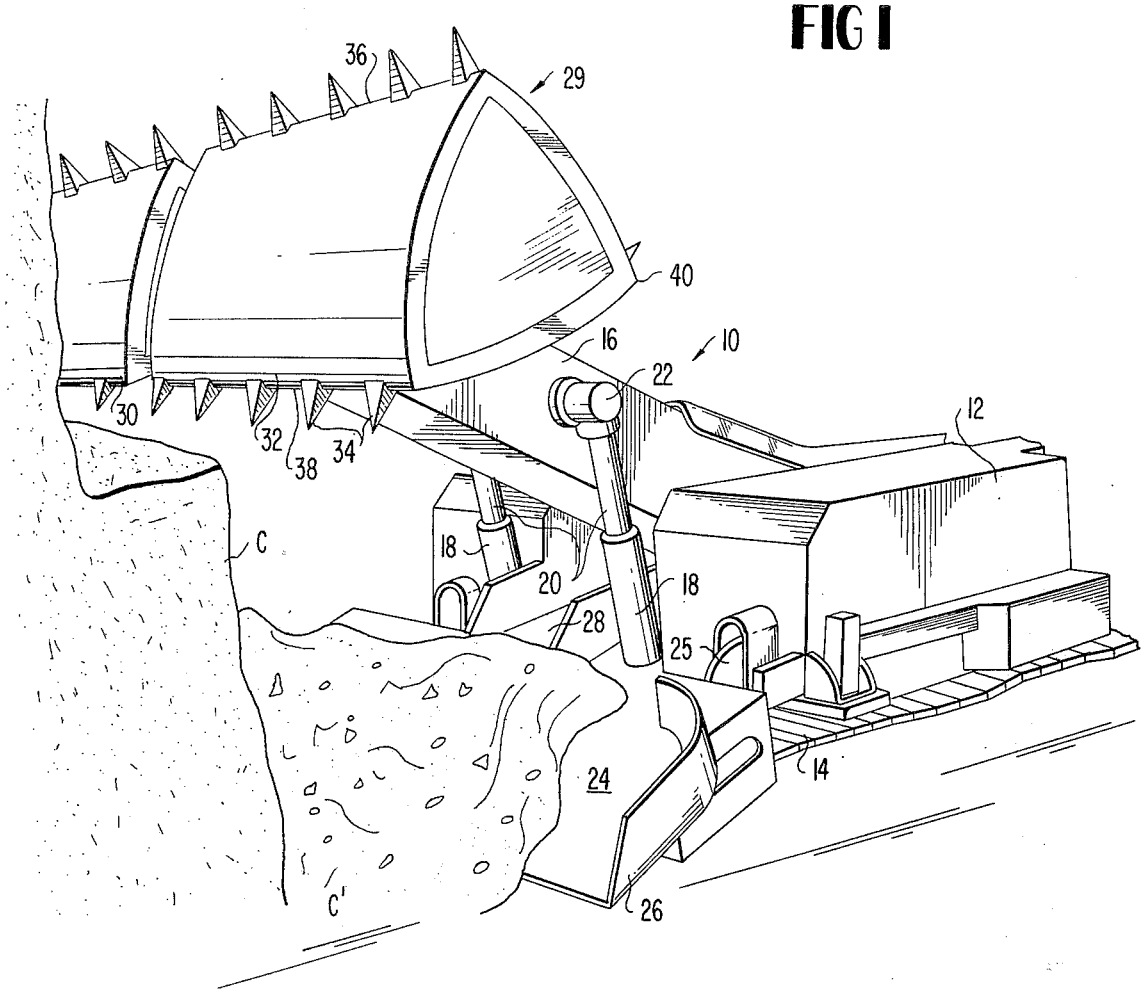
FIG. 1 is a perspective view of one embodiment of the improved linear cutting rotary head continuous mining machine of the present invention.
Figure 4:
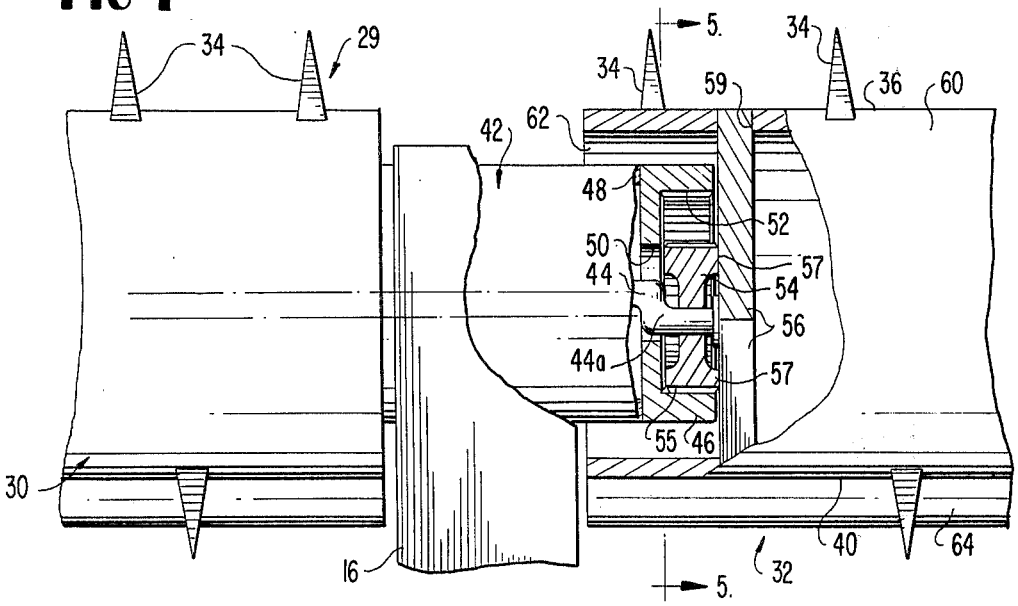
FIG. 4 is a front elevational view of a portion of the machine of FIG. 1, partially in section, illustrating the construction of the linear cutting rotary head assembly.
Figure 5:
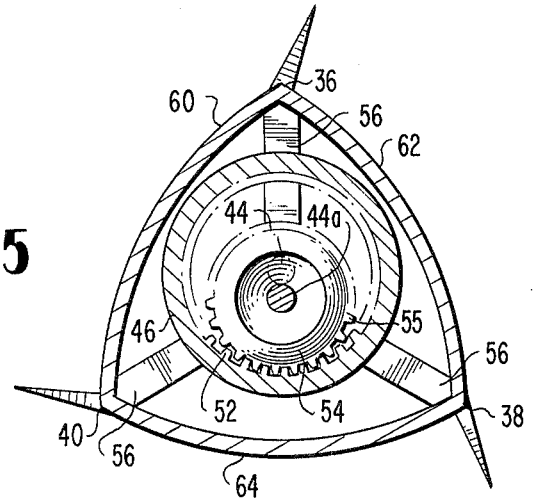
FIG. 5 is a sectional view of a portion of the linear cutting rotary head assembly of FIG. 4 taken about line 5—5.

Reference to FIGS. 1, 4 and 5 illustrates the present invention as a modification to a conventional continuous rotary head mining machine 10. In that respect, the machine 10 is of conventional design and consists of a chassis 12 being mounted for movement in the direction of the longitudinal axis of the chassis 12 by means of tracks as at 14 or the like, permitting the machine to move forwardly with respect to a coal formation of vein C and to effect a cutting action with respect to that coal deposit; whereupon, the cut coal C′ which breaks up during the cutting action falls by gravity in front of the uncut portion of the coal formation on a scoop or shovel 24 which is fixed to the chassis 12 by hinge connection means 25, the scoop or shovel 24 carrying appropriate lateral walls 26 which tend to guide the cut and broken coal fragments towards the center of the shovel 24 for removal to the rear of the machine by a conveyor mechanism indicated generally at 28. This portion of the machine is conventional as is the structural make up and operation of pivotable boom 16. The boom 16 is pivotably supported at the rear of the machine by means (not shown), such that it rotates through a vertical arc caused by extension and retraction of a pair of pistons 20 supported by hydraulic cylinders 18 and coupled to the boom by means of trunions 22. Again, this portion of the machine is conventional and is unmodified by incorporation of the present invention, the boom 16 being raised or lowered to present the rotary cutting head assembly to different positions with respect to the coal formation C.

The present invention is directed to the rotary cutting head assembly, indicated generally at 29 which comprises left and right side cutting heads or drums 30 and 32 when viewed from the front of the machine, FIGS. 1 and 4. Each cutting head assembly carries fixedly mounted cutting bits of pyramidal configuration as at 34 along particular edges thereof. The present invention is particularly directed to the employment of rotary cutting heads or drums 30 and 32 of triangular cross-sectional configuration mounted and driven such that the apices of the triangular-shaped rotary cutting heads follow a square path with the apices carrying the cutting bits 34 and thus causing the cutting bits to follow a square cutting path and to enter the face of the coal formation C at one (top) corner and make a long lineal cut at a constant depth and over one and one-half times the diameter of the rotary head making the cutting motion.

By reference to FIG. 4, it may be seen that the boom 16 terminates at its outboard end relative to chassis 12 in a rotary cutting head drive motor which is indicated generally at 42, this motor being an electric motor, hydraulic motor, pneumatic motor or the like, but being constituted by an outer housing 48 of circular configuration. Rotatably supported to the sides of boom 16 are heads 30 and 32. A crank 44 which has an axis of rotation coaxial with that of the motor housing 48 and being driven therein terminates in eccentric portions **44*a* at the outboard ends of the crank. Fixedly mounted to the motor housing 48, on each side of motor 42, are ring gears 46 which may comprise integral parts of the circular motor housing 48. Each ring gear carries internal gear teeth as at 52. The crank 44 extends through a circular hole 50 within the center of each ring gear 46, the hole 50 being of sufficient size to permit the eccentric portions 44*a* of the crank to rotate freely within the fixed ring gears 46. In the illustrated embodiment, pinion gears 54 are rotatably mounted on the eccentric portions 44*a* of the crank 44 so as to rotate about the axis of the eccentric portions 44*a* in response to rotation of the crank 44. The pinion gears 54 carry gear teeth 55 on their peripheries which are in mesh with the gear teeth 52 of the ring gears 46. Preferably, the ring gears 52 have a gear ratio of four to three to pinion gears 54 so that for every four revolutions of crank shaft 44,** the internal eccentric driven pinion gears will have rotated three revolutions.

Each rotary head or drum 30 and 32 takes the shape in cross-section of an expanded (spherical) equilateral triangle. The head incorporates three mounting arms 56 defining a triangle support for the head, the arms being fixedly mounted at 57, FIG. 4, to an end face of the pinion gear 54 with arms 56 being fixed at their outboard ends 59 to the drums or heads. The drums or heads comprise three sidewalls or faces as at 60, 62 and 64, which are joined at their longitudinal edges to form apices 36, 38 and 40. All of the members of the rotary head assembly 29 may be formed appropriately of metal with the parts being suitably welded together or affixed by other conventional means. By energization of the motor 42, the drums or rotary heads 30 and 32 will be rotated about the axis of the eccentric portion of crank 44 in such a manner that the drums follow an eccentric ellipse and the tips of each cutting bit 34, FIG. 2, follow a square path defined by straight lines except for a slight radius at the corners, where transition of the bit motion occurs from the vertical to the horizontal portion of the rectangular path or vice versa.

Figure 2:
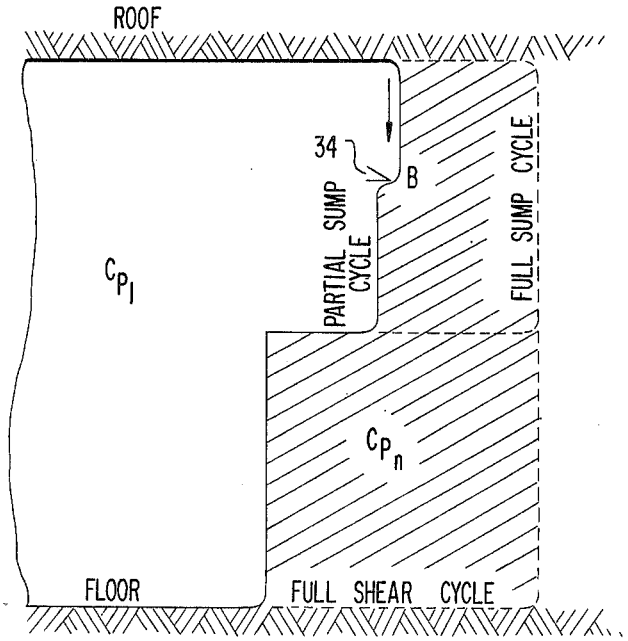
FIG. 2 is a diagrammatic view of the cutting path of the linear cutting rotary head of the machine of FIG. 1 during machine operation.

FIG. 2 illustrates the cutting path of one tip B of one bit 34 during the sump cycle with the shear cycle being the same except horizontal. It is to be noted, that this linear cutting rotary head concept works in similar fashion on all four sides of a box cut. This allows the head to be sumped its full diameter before a shear cut is started, with the shear cut also removing the coal by a linear cut. The only difference between sump and shear is a linear sump cut perpendicular to the bedding and a linear shear cut horizontal to the bedding (not parallel thereto).

Figure 3:
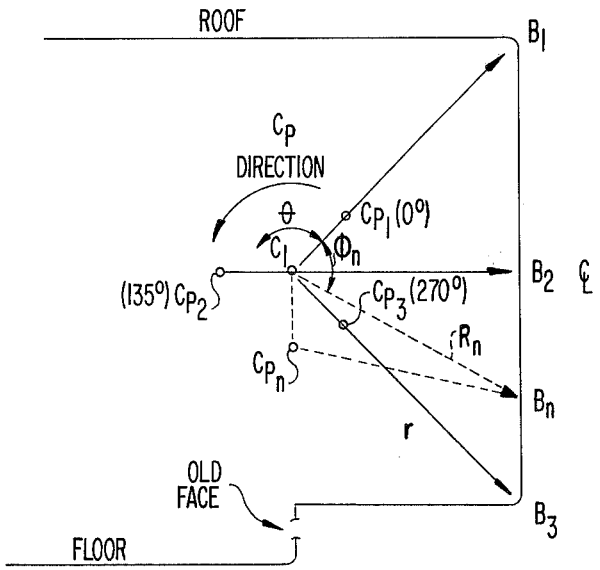
FIG. 3 is a diagrammatic view of the cutting path of the linear cutting rotary head of the machine of FIG. 1 illustrating the change in position of the parts effecting the movement of the cutting bits performing the cutting action.

Further appreciation of the cutting action of the improved linear cutting rotary head assembly of the present invention may be had by the following mathematical description with reference to FIGS. 2 and 3. It may be seen that the cutter bits 34 which are mounted on respective apices of the triangular-shaped rotary cutting heads or drums 30 and 32 and which bits incidentally for respective apices are offset relative to the longuitudinal axis of the cutting head, will follow a linear path from roof to floor at the mine face during the rotary motion of the ring and pinion. The movement of the tip B of each cutting bit 34 which is shown in FIG. 3 for a distance R about the center of the internal gear 46, is covered by the equation:

$$R = \sqrt{E^2 + 2Er(\cos\theta\cos\frac{\theta}{3} - \sin\theta\sin\frac{\theta}{3}) + r^2}$$

where:

E equals the eccentric length of ⅛ length of pitch diameter or internal ring gear 48, *r* equals the apex length of the cutting arm from the center of rotary pinion gear 54 (Cp) to tip Bn of cutter bit, $\theta$ equals the angle made by $C_lC_{pn}$ and $C_lB_1$ about the drive axis and the output shown by $\phi_n$ = angle < $B_n$ $C_lB_1$.

From the above, one complete square cutting path for any bit 34 will be described by $6\pi$ radians for the angle $\theta$.

It may be seen by reference to FIG. 3, and from the equation, that the distance R reaches the maximum at the top ($B_1$) and the bottom ($B_3$) corners of the cut where the eccentric arm ($C_l$, $C_{p1}$) is at 0° ($C_{p1}$) and 270° ($C_{p3}$). The minimum distance R is obtained at the horizontal center line of the head ($B_2$) when the eccentric arm ($C_l$, $C_{p2}$) is at 135° ($C_{p2}$). Using this description, $B_n$ can be plotted for any angle $\theta$ at $C_{pn}$, and this is the manner in which the cutter path shown in FIG. 2 was developed.

Further, if the two dimensional figures of FIGS. 2 and 3 are visualized as being three dimensional with the long dimension being an elongation of the triangle perpendicular to the sheet of drawings, then such a device is seen as capable of carrying several bits suitably spaced at the various apices of the elongated triangular-shaped cutting heads as seen in FIG. 1. Thus, each bit at any apex of the eccentrically rotated triangles for both heads or drums will follow a path best described as a square. This permits the triangular-shaped head to be mounted horizontally on a mining machine boom as a replacement for the standard rotary head as illustrated, and when the triangular-shaped head is driven by an appropriately geared ring and pinion in an eccentric path, then the cutting bits 34 mounted at the apices will take a square face cut at a constant depth after being sumped.

From the above, laboratory linear cutting experiments combined with the theoretical analysis of the rotary cut lead to the conclusions as follows:

1. Both specific airborne respiral dust and specific non-airborne respiral dust are monitonically increasing functions of specific energy.
2. Specific dust and specific energy are inversely proportional to the depth of cut.
3. An optimum value of the space to depth ratio of the cutting bits exists between 2 and 3 for linear cutting.
4. Rotary cutting has an inherent bit spacing problem since the correct bit spacing is only obtained at maximum depth for each bit.
5. Rotary cutting is an inherently poor low volume recovery in the first 60% of advance distance for each bit on the drum making this portion of the rotary cut highly inefficient with abnormal amounts of dust.
6. Specific airborne respirable dust generated from the rotary cut is greater than that generated from the linear cut.

In conclusion, the laboratory results show that the greatest dust generated per unit volume occurs at cuts less than one inch deep, and it becomes apparent that all cutting should occur deeper than one inch. From the analysis of the rotary cut, it is equally apparent that when a bit enters the coal face at zero depth, goes to some maximum depth, and exits the face at zero depth due to its mechanical configuration, as in the standard continuous mining machine, it is inherently a high energy, dusty cutting mechanism.

The linear cutting rotary head modified continuous mining machine of the present invention as described above completely eliminates these problems and minimizes respirable dust generation. With respect to the illustrated embodiment, it should be noted that the drum cross-section may take the shape of modified equilateral triangles whose sides may be changed symmetrically into other forms of conic section as are compatible with gear sizes and head sizes needed for the coal seam being cut, and that auxiliary fragmentation subsystems may be placed at the cutting bits 34, the subsystems may include thermal heaters, hydraulic impact rams, electromagnetic heating, mechanical impact, high pressure liquid jets or any combination of the same.

What is claimed is:

1. A continuous mining machine for mining a horizontally extending coal vein or the like, said machine comprising:

a chassis movable longitudinally parallel to said vein a boom carried by said chassis for pivotable movement at right angles to the direction of chassis movement, shaft means mounted to said boom for rotation about its axis at right angles to the longitudinal axis of said boom, means for rotating said shaft, at least one rotary cutting head, triangular-shaped in cross section mounted on said shaft for rotation about an elliptical eccentric path, and longitudinally spaced cutting bits mounted on said triangular-shaped rotary head at the apices thereof;

whereby, said cutting bits follow a square cutting path during rotation of said at least one rotary head and effect linear shear and sump cuts of said coal vein during rotation thereof.

2. The continuous mining machine as claimed in claim 1, wherein said gear ratio between said pinion means and said ring gear is 3 to 4.

3. The continuous mining machine as claimed in claim 1, wherein a plurality of bits are carried on said at least one rotary cutting head on each apex thereof, and wherein the bits of one apex are longitudinally offset with respect to the bits carried on another apex.

4. The continuous mining machine as claimed in claim 1, wherein the longitudinal faces of said at least one rotary cutting head comprise spherical segments joined at their longitudinal edges.

5. The continuous mining machine as claimed in claim 1, wherein said rotary cutting heads comprise two in number, said means for rotating said shaft comprises a motor fixedly mounted to said boom, and said rotary heads are operatively coupled to said motor on respective sides of said boom.

6. The continuous mining machine as claimed in claim 1, wherein said shaft means comprises a crank arm mounted for rotation about an axis at right angles to the longitudinal axis of said boom, said crank arm having an eccentric portion, pinion means is mounted on said eccentric portion for rotation about the axis of the eccentric portion of said crank, a ring gear concentric with the axis of rotation of said crank and having internal gear teeth in mesh with gear teeth on the periphery of said pinion for controlling the rotational path of said pinion as said crank rotates with respect to said ring gear, and means for fixedly mounting said at least one triangular-shaped cutting head to the side of said pinion gear so as to rotate eccentrically with respect to said crank axis.

7. The continuous mining machine as claimed in claim 6, wherein said gear ratio between said pinion means and said ring gear is 3 to 4.

8. The continuous mining machine as claimed in claim 9, wherein said gear ratio between said pinion means and said ring gear is 3 to 4.

9. The continuous mining machine as claimed in claim 1, wherein: said at least one rotary head comprises three edge joined faces, said cutting bits project outwardly from said at least one cutting head at said apices and are generally in line with the trailing face at each apex in terms of the direction of rotation of said head.

10. The continuous mining machine as claimed in claim 6, wherein a plurality of bits are carried on said at least one rotary cutting head on each apex thereof, and wherein the bits of one apex are longitudinally offset with respect to the bits carried on another apex.

* * * * *